US009755378B2

(12) United States Patent
Holliday et al.

(10) Patent No.: US 9,755,378 B2
(45) Date of Patent: Sep. 5, 2017

(54) MINI COAX CABLE CONNECTOR

(71) Applicant: PPC Broadband, Inc., East Syracuse, NY (US)

(72) Inventors: Randall A. Holliday, Broomfield, CO (US); Jimmy Yao, Taipei (TW)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 15/060,882

(22) Filed: Mar. 4, 2016

(65) Prior Publication Data

US 2016/0190752 A1 Jun. 30, 2016

Related U.S. Application Data

(63) Continuation of application No. 14/027,877, filed on Sep. 16, 2013, now Pat. No. 9,281,637, which is a continuation-in-part of application No. 13/400,282, filed on Feb. 20, 2012, now Pat. No. 8,535,092, and a continuation of application No. 12/685,606, filed on Jan. 11, 2010, now Pat. No. 8,142,223, and a continuation-in-part of application No. 11/895,367, (Continued)

(51) Int. Cl.

| | |
|---|---|
| ***H01R 24/40*** | (2011.01) |
| ***H01R 24/38*** | (2011.01) |
| ***H01R 9/05*** | (2006.01) |
| *H01R 103/00* | (2006.01) |
| *H01R 24/44* | (2011.01) |

(52) U.S. Cl.

CPC ..... *H01R 24/40* (2013.01); *H01R 9/0518* (2013.01); *H01R 24/38* (2013.01); *H01R 24/44* (2013.01); *H01R 2103/00* (2013.01)

(58) Field of Classification Search

CPC .. H01R 9/0524; H01R 24/38; H01R 2103/00; H01R 43/20; H01R 24/40; H01R 9/05; H01R 13/5205; H01R 43/26; H01R 13/622; H01R 24/56; H01R 9/0521; H01R 12/7082; H01R 12/712; H01R 13/08; H01R 13/50

See application file for complete search history.

(56) References Cited

U.S. PATENT DOCUMENTS

| | | | |
|---|---|---|---|
| 2,369,180 | A | 2/1945 | Rosenthal |
| 3,126,750 | A | 3/1964 | Willis |

(Continued)

OTHER PUBLICATIONS

Office Action (Mail Date: Nov. 30, 2012) for U.S. Appl. No. 13/400,282, filed Feb. 20, 2012.

(Continued)

*Primary Examiner* — Truc Nguyen
(74) *Attorney, Agent, or Firm* — Barclay Damon, LLP

(57) ABSTRACT

A cable connector comprising a connector body, a compression member operably connected to a second end of the connector body, the compression member including a compression portion having a forward facing surface, wherein the compression portion protrudes from an inner surface of the compression member, wherein, when the compression member is slidably axially compressed within the connector body, the compression portion of the compression member compresses an inner sleeve into crimping engagement with a coaxial cable is provided. An associated method is also provided.

38 Claims, 12 Drawing Sheets

Related U.S. Application Data filed on Aug. 24, 2007, now Pat. No. 7,645,161, and a continuation-in-part of application No. 11/716,488, filed on Mar. 9, 2007, now Pat. No. 8,464,422, and a continuation-in-part of application No. 10/927,884, filed on Aug. 27, 2004, now Pat. No. 7,188,507.

(56) References Cited

U.S. PATENT DOCUMENTS

| | | | | |
|---|---|---|---|---|
| 3,296,363 | A | 1/1967 | Laudig et al. | |
| 4,668,043 | A | 5/1987 | Saba et al. | |
| 4,684,201 | A | 8/1987 | Hutter | |
| 4,685,201 | A | 8/1987 | Boyd, Jr. | |
| 4,902,246 | A | 2/1990 | Samchisen | |
| 4,932,091 | A | 6/1990 | Krzyzanski | |
| 5,024,606 | A | 6/1991 | Ming-Hwa | |
| 5,073,129 | A | 12/1991 | Szegda | |
| 5,105,648 | A | 4/1992 | Steiner et al. | |
| 5,127,853 | A | 7/1992 | McMills et al. | |
| 5,269,701 | A | 12/1993 | Leibfried, Jr. | |
| 5,392,508 | A | 2/1995 | Holliday et al. | |
| 5,469,613 | A | 11/1995 | McMills et al. | |
| 5,470,257 | A | 11/1995 | Szegda | |
| 5,479,613 | A | 12/1995 | Geyer et al. | |
| 5,501,616 | A | 3/1996 | Holliday | |
| 5,529,513 | A | 6/1996 | Lee | |
| 5,546,653 | A | 8/1996 | Tournier et al. | |
| 5,586,910 | A | 12/1996 | Del Negro et al. | |
| 5,595,499 | A | 1/1997 | Zander et al. | |
| 5,651,698 | A | 7/1997 | Locati et al. | |
| 5,651,699 | A | 7/1997 | Holliday | |
| 5,667,405 | A | 9/1997 | Holliday | |
| 5,845,393 | A | 12/1998 | Depaiva | |
| 5,863,220 | A | 1/1999 | Holliday | |
| 5,934,137 | A | 8/1999 | Tarpill | |
| 5,975,949 | A | 11/1999 | Holliday et al. | |
| 5,997,350 | A | 12/1999 | Burris et al. | |
| 6,089,913 | A | 7/2000 | Holliday | |
| 6,112,404 | A | 9/2000 | Tarpill | |
| 6,146,197 | A | 11/2000 | Holliday | |
| 6,153,830 | A | 11/2000 | Montena | |
| 6,293,004 | B1 | 9/2001 | Holliday | |
| 6,305,978 | B1 | 10/2001 | Ko et al. | |
| 6,352,448 | B1 | 3/2002 | Holliday | |
| 6,594,888 | B2 | 7/2003 | Chang | |
| 6,708,396 | B2 | 3/2004 | Holliday | |
| 6,783,394 | B1 | 8/2004 | Holliday | |
| 6,805,583 | B2 | 10/2004 | Holliday et al. | |
| 6,830,479 | B2 | 12/2004 | Holliday | |
| 6,848,940 | B2 | 2/2005 | Montena | |
| 6,916,200 | B2 | 7/2005 | Burris et al. | |
| 6,929,508 | B1 * | 8/2005 | Holland | H01R 9/0518 439/579 |
| 6,935,892 | B2 | 8/2005 | Holliday | |
| 6,948,234 | B1 | 9/2005 | Steiner | |
| 7,025,246 | B2 | 4/2006 | Wild | |
| 7,029,326 | B2 | 4/2006 | Montena | |
| 7,044,771 | B2 | 5/2006 | Holliday | |
| 7,070,447 | B1 | 7/2006 | Montena | |
| 7,108,547 | B2 | 9/2006 | Kisling | |
| 7,131,868 | B2 | 11/2006 | Montena | |
| 7,156,695 | B2 | 1/2007 | Holliday | |
| 7,156,696 | B1 | 1/2007 | Montena | |
| 7,179,122 | B2 | 2/2007 | Holliday | |
| 7,182,628 | B2 | 2/2007 | Holliday | |
| 7,188,507 | B2 | 3/2007 | Holliday et al. | |
| 7,326,079 | B2 | 2/2008 | Holliday et al. | |
| 7,367,832 | B2 | 5/2008 | Muhs et al. | |
| 7,410,389 | B2 | 8/2008 | Holliday | |
| 7,507,116 | B2 | 3/2009 | Laerke et al. | |
| 7,645,161 | B2 | 1/2010 | Holliday | |
| 7,727,015 | B2 | 6/2010 | Holliday | |
| 8,075,339 | B2 | 12/2011 | Holliday | |
| 8,142,223 | B2 | 3/2012 | Holliday | |
| 8,464,422 | B2 | 6/2013 | Holliday et al. | |
| 2005/0148236 | A1 | 7/2005 | Montena | |
| 2006/0042346 | A1 | 3/2006 | Holliday et al. | |
| 2006/0105628 | A1 * | 5/2006 | Montena | H01R 9/0524 439/578 |
| 2006/0240709 | A1 | 10/2006 | Montena et al. | |
| 2008/0096419 | A1 * | 4/2008 | Purdy | H01R 9/0527 439/578 |
| 2010/0144200 | A1 | 6/2010 | Holliday | |
| 2010/0151728 | A1 * | 6/2010 | Chabalowski | H01R 9/0521 439/584 |
| 2010/0255720 | A1 * | 10/2010 | Radzik | H01R 24/40 439/578 |
| 2012/0270442 | A1 | 10/2012 | Holliday | |

OTHER PUBLICATIONS

Notice of Allowance (Mail Date: Mar. 21, 2013) for U.S. Appl. No. 13/400,282, filed Feb. 20, 2012.

U.S. Patent and Trademark Office (ISA/US), International Search Report and Written Opinion from PCT/US14/55398 as completed Dec. 1, 2014 (total 13 pgs.).

* cited by examiner

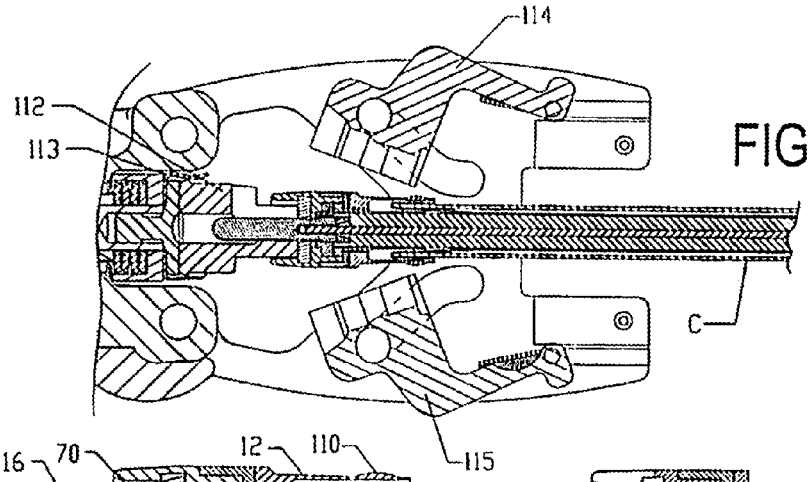
FIG. 14
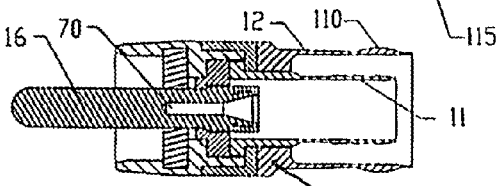
FIG. 15 10'
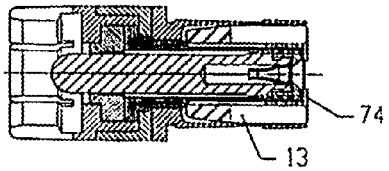
FIG. 16

MINI COAX CABLE CONNECTOR

CROSS-REFERENCE TO RELATED APPLICATIONS

This application is a continuation of U.S. application Ser. No. 14/027,877, filed Sep. 13, 2013, and entitled "MINI COAX CABLE CONNECTOR", which is a continuation-in-part of U.S. application Ser. No. 13/400,282, filed Feb. 20, 2012, and entitled "Mini Coax Cable Connector," which is a continuation of U.S. application Ser. No. 12/685,606, filed Jan. 11, 2010, now U.S. Pat. No. 8,142,223, which is a continuation-in-part of U.S. application Ser. No. 11/895,367, filed Aug. 24, 2007, now U.S. Pat. No. 7,645,161, which is a continuation-in-part of U.S. application Ser. No. 11/716,488, filed Mar. 9, 2007, now U.S. Pat. No. 8,464,422, which is a continuation-in-part of U.S. application Ser. No. 10/927,884, filed Aug. 27, 2004, now U.S. Pat. No. 7,188,507. All of these applications are incorporated by reference herein in their entireties.

BACKGROUND

The following relates to coaxial cable connectors and more particularly relates to a novel and improved mini-coaxial cable connector assembly which is conformable for use with different size cables in effecting positive engagement with a connector assembly in connecting the cable to a post or terminal.

The problems associated with the connection of mini-coaxial cables as well as larger size cables to a post or terminal in the field are discussed at some length in hereinabove referred to co-pending application for patent for MINI-COAXIAL CABLE CONNECTOR and in U.S. Pat. No. 6,352,448 for CABLE TV END CONNECTOR STARTER GUIDE. This invention is directed to further improvements in termination assemblies to be employed for mini coaxial cables in which the termination assembly is characterized in particular by being comprised of a minimum number of preassembled parts which can be quickly assembled at the manufacturing site as well as in the field and is readily conformable for connection of different sized mini-coaxial cables to BNC and RCA connectors. Further wherein an extension tip can be recessed to permit a conductor to be positioned toward the back of the connector assembly, such as, for example, RCA connector assemblies; and including a novel form of centering guide for guiding the conductor into the recessed end of the extension tip.

SUMMARY

In one aspect it is desirable to eliminate any form of a coupling or adaptor sleeve for small diameter coaxial cables so that the cable can be installed directly into the end of an extension tip which has been preassembled within the connector body.

In another aspect the connector body is provided with the necessary adaptability for connection to different sized cables and in such a way as to assure accurate alignment between the cable and connector preliminary to crimping of the connector onto the cable and prevents shorting between the cable layers with one another as well as with conductive portions of the connector; and specifically wherein inner and outer concentric compression members in the crimping region of the connector body cooperate in effecting positive engagement with the cable.

The foregoing is achieved by direct connection of the exposed end of a coaxial cable to an extension tip either prior to or after mounting of the extension tip in a hollow connector body wherein the cable is of the type having inner and outer concentric electrical conductors, an annular dielectric separating the conductors and an outer jacket of electrically non-conductive material, the inner and outer conductors being exposed at the end and the inner conductor projecting beyond the dielectric at one end of the cable; and the connector body is characterized by having a slotted compression ring which cooperates with an inner slotted sleeve to effect positive engagement with the cable in response to radially inward compression. The inner sleeve and compression ring are dimensioned to undergo the necessary compression in response to axial advancement of a crimping ring, and the trailing end of the inner sleeve is slotted to form prong-like segments having internal and external teeth so that the trailing end of the sleeve can be compressed into engagement with the cable without crushing the dielectric layer.

A spring-like retainer clip within a bore at one end of the extension tip is adapted to grasp the conductor pin and connect to the tip, and the retainer clip can be varied in size for different diameter conductor pins. Elimination of the adaptor sleeve on the cable affords greater latitude in visualization of the color of the extension tip as well as the compression ring; and either or both may be color-coded to match up with different sized cables.

A further aspect relates generally to cable connector comprising: a connector body, a compression member operably connected to a second end of the connector body, the compression member including a compression portion having a forward facing surface, wherein the compression portion protrudes from an inner surface of the compression member, wherein, when the compression member is slidably axially compressed within the connector body, the compression portion of the compression member compresses an inner sleeve into crimping engagement with a coaxial cable.

A further aspect relates generally to a coaxial cable connector having a hollow connector body, wherein the coaxial cable connector includes an elongated conductor pin and wherein said coaxial cable connector includes an inner sleeve disposed within the connector body, comprising an extension tip inserted in a main bore of the connector body, the tip provided with a recess at one end for insertion of the conductor pin and an extension rod removably connected to an opposite end of the tip and wherein the tip and the rod are slidable through the connector body in response to axial movement of the cable and pin through the connector body; and a compression member operably connected to a second end of the connector body for compressing a slotted end of the inner sleeve into engagement with a coaxial cable.

A further aspect relates generally to a method comprising: providing a connector having a connector body, a compression member operably connected to a second end of the connector body, the compression member including a compression portion having a forward facing surface, wherein the compression portion protrudes from an inner surface of the compression member, and axially advancing the compression portion to radially compress a slotted end of an inner sleeve disposed within the connector body into crimping engagement with a coaxial cable.

It is therefore to be understood that even though numerous characteristics and advantages of the present invention have been set forth in the foregoing description, together with details of the structure and function of the invention, the disclosure is illustrative only, and changes may be made within the principles of the invention to the full extent indicated by the broad general meaning of the terms in which the appended claims are expressed and reasonable equivalents thereof.

BRIEF DESCRIPTION

The above and other objects, advantages and features of the present invention will become more readily appreciated and understood from a consideration of the following detailed description of preferred and modified forms of the present invention when taken together with the accompanying drawings in which:

FIG. 14 is a somewhat fragmentary, longitudinal sectional view of a compression tool utilized in combination with another embodiment of a connector assembly;

FIG. 15 is a sectional view in more detail of the connector assembly shown in FIG. 14;

FIG. 16 is a sectional view of the end of another form of connector assembly utilized with mini-coaxial cable connectors;

DETAILED DESCRIPTION OF ONE EMBODIMENT

Figure 1:
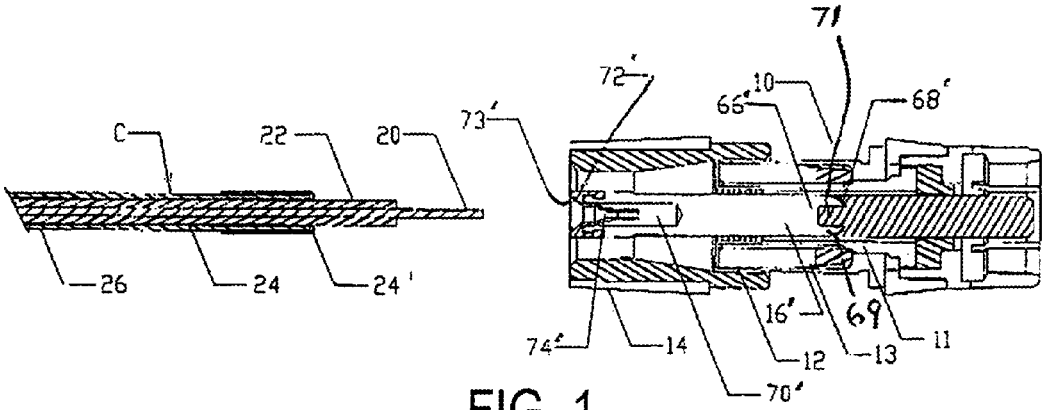
FIG. 1 is an exploded, longitudinal sectional view of one embodiment comprised of the standard mini-coaxial cable prior to insertion into a connector assembly having a modified pre-assembled extension tip.

Referring in more detail to the drawings, there is illustrated in FIGS. 1 to 8 one embodiment which is comprised of a standard mini-coaxial cable C, a hollow connector body 10 having inner and outer concentric sleeves 11 and 12, and a plastic compression ring 13. A crimping ring assembly 14 is preassembled at one end of the body 10, and a modified extension tip 16' is preassembled at the opposite end of the body 10 to the crimping ring assembly 14.

As a setting for the embodiments to be described, the cable C is made up of an inner conductor pin or wire 20 which is surrounded by a dielectric insulator 22 of electrically nonconductive material, such as, a rubber or rubber-like material, a braided conductor layer 24, and an outer jacket 26 of an electrically non-conductive material, such as, a rubber or rubber-like material. The end of the cable C is further prepared for assembly by removing a limited length of the jacket 26 and braided conductor 24 as well as the insulated layer 22 in order to expose an end of the pin 20 along with a foil layer surrounding the pin 20. The braided conductor layer 24 is peeled away from the insulator 22 and doubled over as at 24' to cover the leading end of the jacket 26.

As shown in FIGS. 1 to 8, the sleeve 11 has a thin-walled, annular trailing end 28 and sealing rings or ribs 29 along its inner surface in facing relation to the jacket 26, and the body 10 terminates in an annular shoulder 30 at one end having an annular end flange 32 in abutting relation to an insulator guide 33. The sleeve 11 is dimensioned such that the trailing end 28 will extend over the end of the doubled-over layer 24' when the pin 20 is inserted into the end of the extension tip 16 in a manner to be described in more detail. For this purpose, the layer 22 is exposed for a length corresponding to the length of the wall portion 28 of the sleeve 11 when assembled in the relationship shown in FIG. 4. The outer sleeve 12 has a thin-walled trailing end 34 aligned in outer spaced concentric relation to the end 28 to form an annular space therebetween for insertion of the compression ring 13, and the trailing end 34 is raised slightly from the outer surface of the sleeve 12 to form a shoulder 27 at one end to receive the offset end 15 of the crimping ring 14. The inner surface of the trailing end 34 is provided with a series of sealing ribs or rings 35 to engage the outer surface of the compression ring 13. The sleeve 12 terminates at its opposite end in a thickened annular end portion 40, including a radially inner wall surface flush with the external wall surface of the end flange 32, and a radially outwardly extending shoulder 39 is interposed between one end of the crimping ring assembly 14 and a reinforcing band 42 on the outside of the connector body 10.

Figure 8:
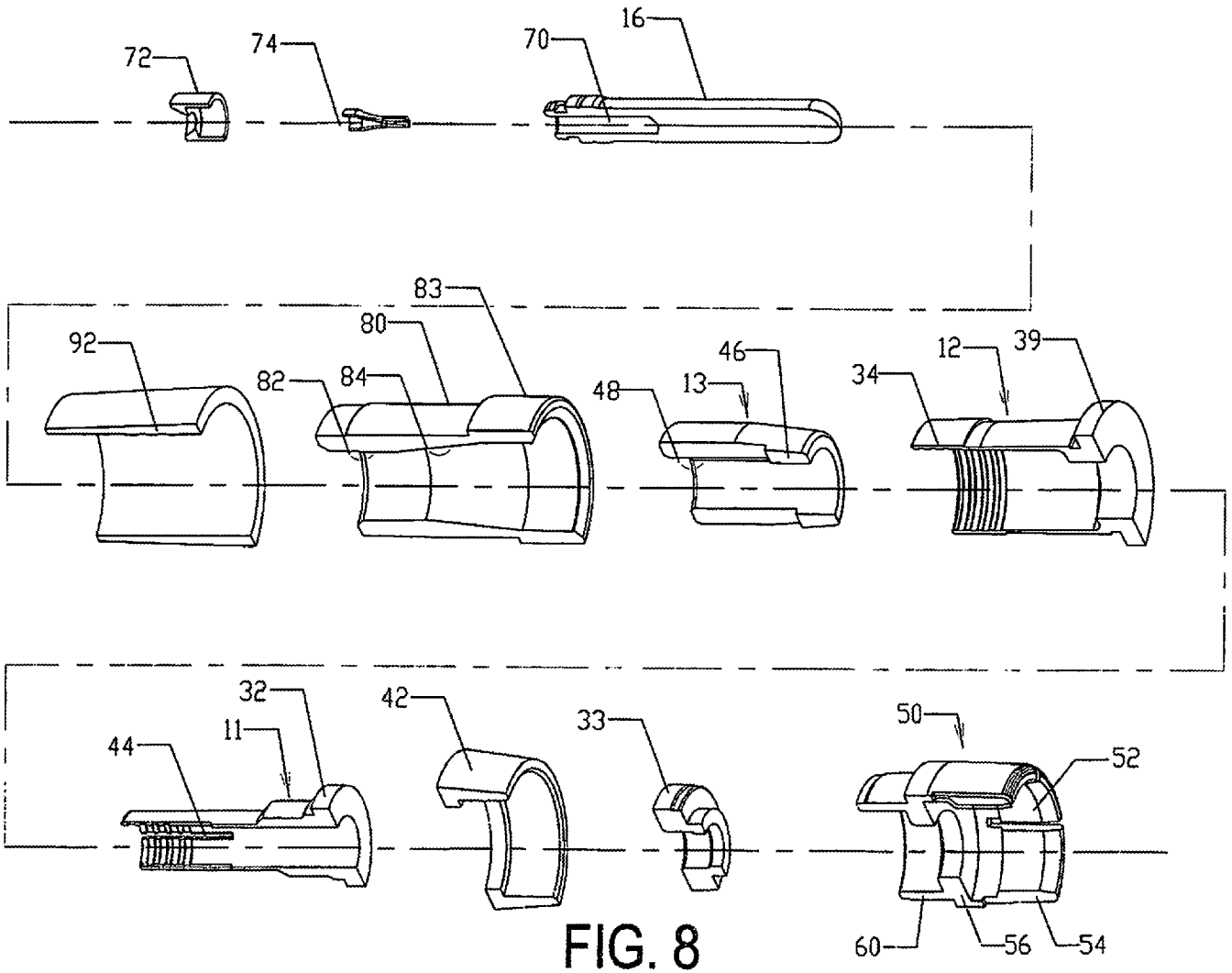
FIG. 8 is an exploded view of the parts comprising the modified extension tip and connector body prior to assembly.

As best seen from the exploded view of FIG. 8, the trailing end 28 of the inner sleeve 11 is provided with circumferentially spaced longitudinal slots 44 of a length substantially corresponding to the slotted end of the compression ring 13 to be described, the slots each being of a width to control the inward degree of bending by the crimping ring assembly 14. Similarly, the compression ring 13 has a solid or continuous annular end 46 and circumferentially spaced longitudinal slots 48 extending from the end 46 for the greater length of the ring 13 toward its trailing end and dividing the ring 13 into a series of elongated annular segments, the slots 48 each being of a width to control the degree of inward bending when compressed by the crimping assembly 14. Further, the compression ring 13 is composed of a plastic material of limited flexibility and dimensioned to be of a thickness to assure positive engagement of the inner sleeve 11 with the cable C when the extension tip 16' is inserted into the body 10. Again, it is important to dimension the width of the slots 48 to limit the amount of contraction of the ring 13 so that the sealing ribs 29 will compress the jacket 26 enough to prevent pull-out but not enough to crush the dielectric layer 22. This is especially important in cables operating at higher frequencies in which any bending or crushing of the dielectric can create an impedance that downgrades the signal and prevents return losses. As further seen from FIG. 3, the prepared cable C is inserted into the tip 16' and advanced through the body 10 until the slotted segments of the inner sleeve 11 are positioned over the doubled-over layer 24' and jacket 26.

Figure 3:
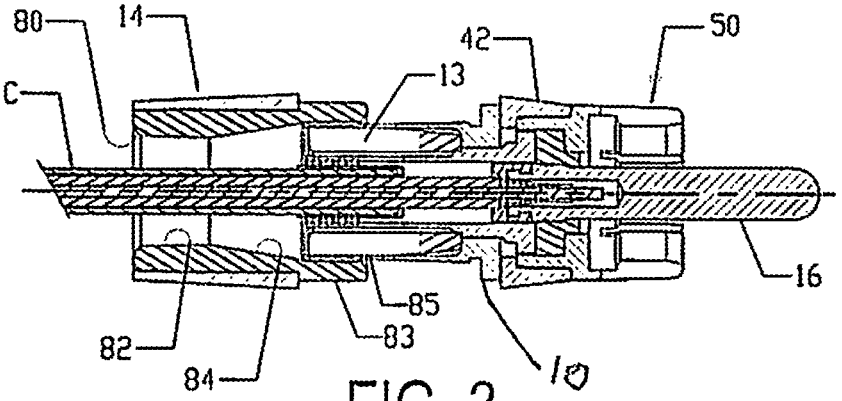
FIG. 3 is another longitudinal sectional view of the one embodiment illustrating advancement of the extension tip and cable through the connector assembly prior to the crimping operation.

The opposite end of the body 10 is made up of a ferrule 50 which is slotted as at 52 into spring-like annular segments 54 extending from an annular base portion 56 of the ferrule 50 to facilitate attachment to a post or terminal, not shown, and the base 56 forms a central opening or passage for advancement of the tip 16 beyond the end of the ferrule, as shown in FIG. 3. The base 56 has a rearward extension or keeper 60 of annular configuration between the band 42 and the guide 33 as well as the flange 39 on the inner sleeve. Thus, the inner walls of the sleeve 11 and guide 33 define the inner wall surface of the body 10, and the guide 33 is provided with an internal shoulder 63 to limit advancement of the extension tip 16 through the body 10.

Figure 2:
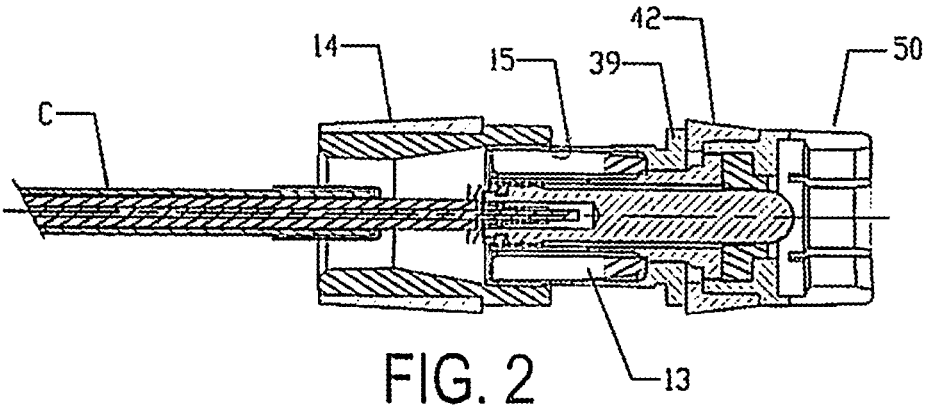
FIG. 2 is a longitudinal sectional view of the one embodiment of FIG. 1 with the mini-coaxial cable inserted into the modified extension tip prior to a crimping operation.

The modified extension tip 16' and cable Care illustrated in exploded form in FIG. 1, the tip 16' being shown inserted into the connector body 10 and comprises an elongated cylindrical metal body 66' terminating in a recessed end 68' for press-fit engagement with a supplementary plastic extension rod 69; and an elongated central bore or recess 70' extends through the opposite end for a limited length of the tip 16'. The extension rod 69 is of a diameter corresponding to the tip 16' with a projecting end 71 of reduced diameter for press-fit engagement with the recessed end 68'. When the extension rod is inserted into the connector body and advanced through the centering guide 33 as shown in FIGS. 1-3, the extension tip 16' will project to a position close to or flush with the end of the crimping ring assembly 14. An annular insulator cap 72' is mounted on the opposite end of the tip 16' in surrounding relation to the entrance to the bore 70 and supports the end of an elongated spring 74' extending through the bore and offset from the wall slightly to bear against the conductor pin 20. The end of the cap 72' is beveled as at 73' to wedge against the dielectric layer 22 surrounding the pin 20 and which is peeled away from the pin 20 into the outer layer 24' as earlier described.

Figure 4:
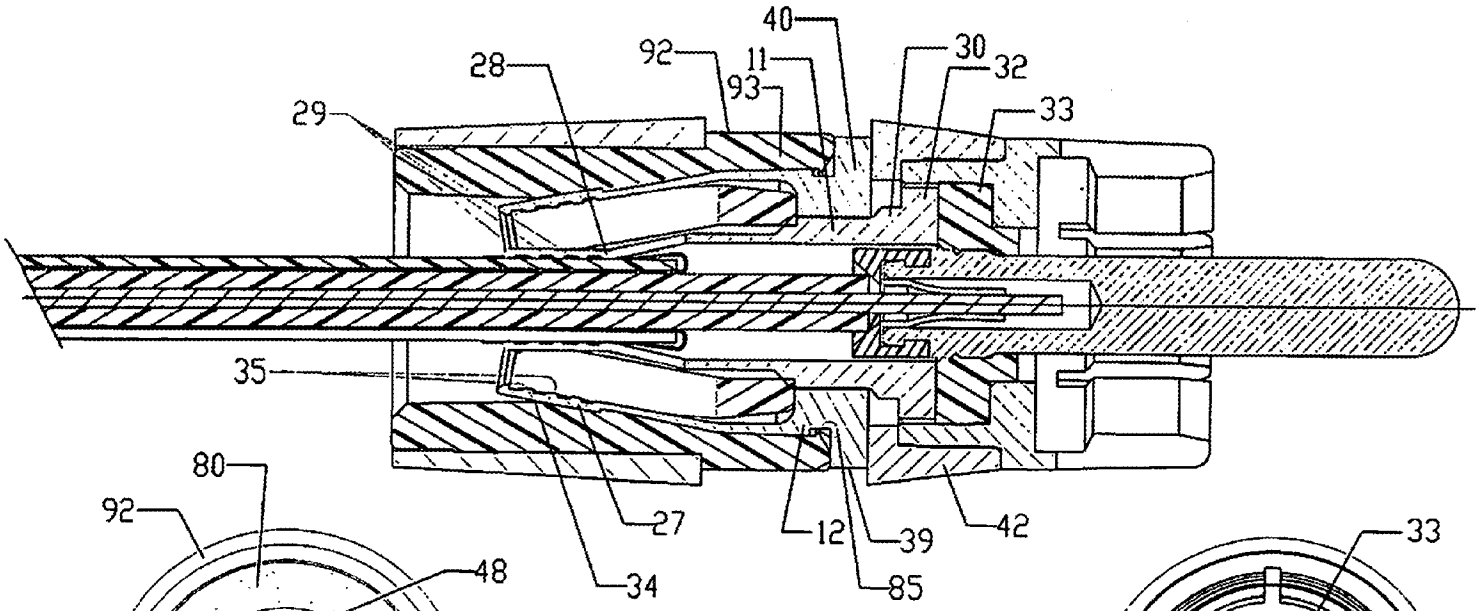
FIG. 4 is an enlarged longitudinal sectional view of the one embodiment following the crimping operation.
Figure 6:
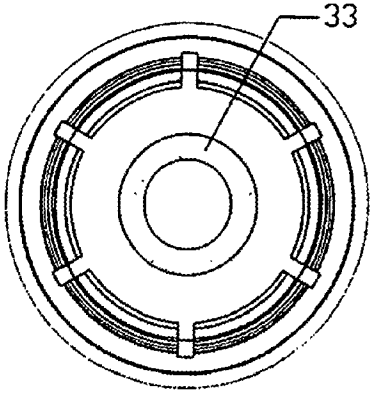
FIG. 6 is an end view of the opposite end of the one embodiment to that shown in FIG. 5.
Figure 5:
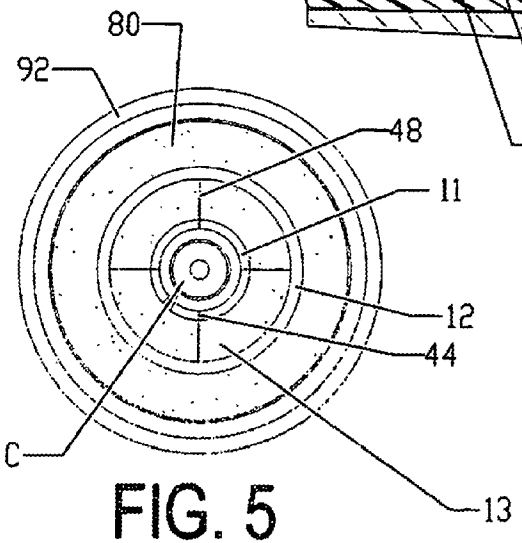
FIG. 5 is an end view of the one embodiment illustrated from the entrance end of the cable.
Figure 7:
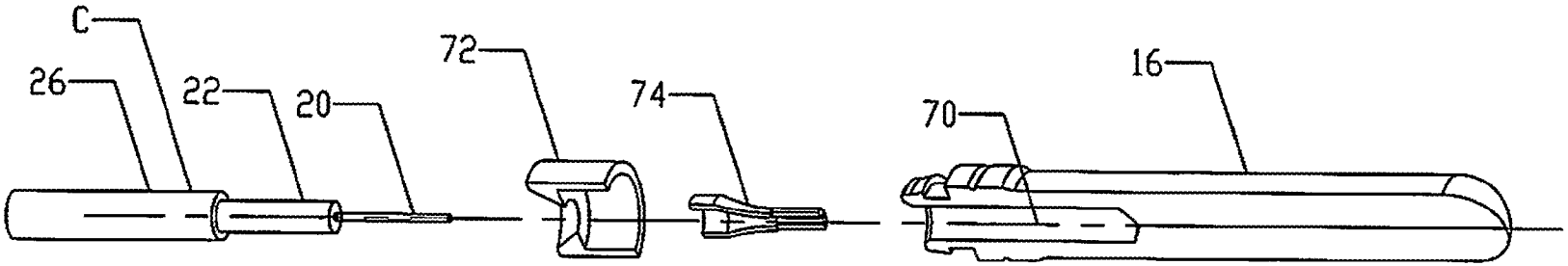
FIG. 7 is an exploded view of the parts comprising the coaxial cable and modified extension tip prior to assembly.

The crimping ring assembly 14 is of a type that can be preassembled onto the connector body 10 and axially advanced over the sleeve 12 to force it into crimping engagement with the slotted end 44 of the compression ring 13. To this end, the crimping ring 14 is made up of an annular body 80 composed of a low-friction material having limited compressibility, such as, DELRIN.RTM, or other hardened plastic material. The body has a straight cylindrical portion 82 and a forwardly tapered portion 84 which terminates in a leading end 83 having an internal shoulder or rib 85. The leading end 83 fits over the trailing end of the sleeve 12 so that the crimping ring 14 can be axially advanced over the end of the sleeve 12 until the internal shoulder or rib 85 advances past the raised end 34, as shown in FIG. 4, to preassemble the ring 14 onto the connector 10.

An exterior surface of the body 80 is recessed or undercut to receive a reinforcing liner 92 which is preferably composed of brass and which fits snugly over the body 80. The leading end 93 of the liner 92 projects outwardly beyond the external surface of the body 80 to define an external shoulder of a diameter slightly greater than that of the leading end 83, as best seen from FIG. 4.

The extension tip 16' is inserted into the connector body 10 until the end of the extension rod 69 opposite to the reduced end 79 is positioned in alignment with the centering guide 33, as shown in FIG. 1, so that the entrance to the bore 70' is at or in close proximity to the entrance to the crimping ring assembly 14 to thereby facilitate insertion of the conductor pin 20 into the beveled end 73' of the bore 70'. The crimping ring assembly 14 is preassembled onto the sleeve 12, as described earlier. Typically, the extension tip 16' and crimping ring 14 are preassembled in the manner just described prior to shipment to the field so that the color coding of the elements is followed to signify the desired cable size and application of the connector assembly to the installer. Although not illustrated in FIGS. 2 and 3, when the cable is advanced to the intermediate position shown in FIG. 2, the extension rod 69 can be removed or permitted to drop off the end of the extension tip 16'. A standard crimping tool, not shown, may be employed to axially advance the crimping ring 14 over the sleeve 12 until the leading end or rib 85 moves into snap-fit engagement with the groove 41 and abuts the shoulder 40. The tapered surface 84 will cause the end portion 34 of the sleeve 12 to radially contract and force the compression ring 13 into positive engagement with the inner sleeve 11 and in turn cause the rings 29 on the segments to be crimped into positive engagement with the jacket 26 as well as the doubled-over portion 24'. One such crimping tool is disclosed in U.S. Pat. No. 6,089,913 and is incorporated by reference herein. The cooperation between the ribs 34 when forced into the compression ring 13 and in turn forcing the internal teeth 29 into engagement with the layer 24' as well as the jacket 26 increases the pull-out strength of the termination assembly both with respect to the end of the cable C and the connector 10.

Detailed Description of a Second Embodiment with Crimping Ring Assembly

Figure 9:
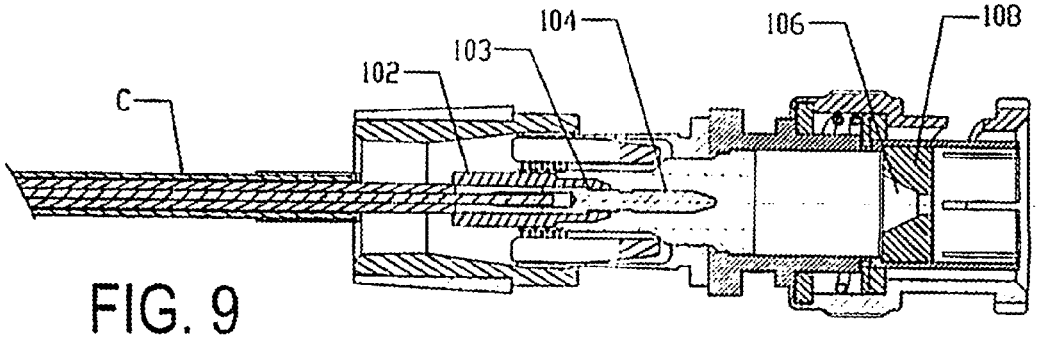
FIG. 9 is a longitudinal sectional view of a second embodiment illustrating a BNC connector assembly and illustrating a mini-coaxial cable inserted into the pre-assembled modified extension tip.
Figure 10:
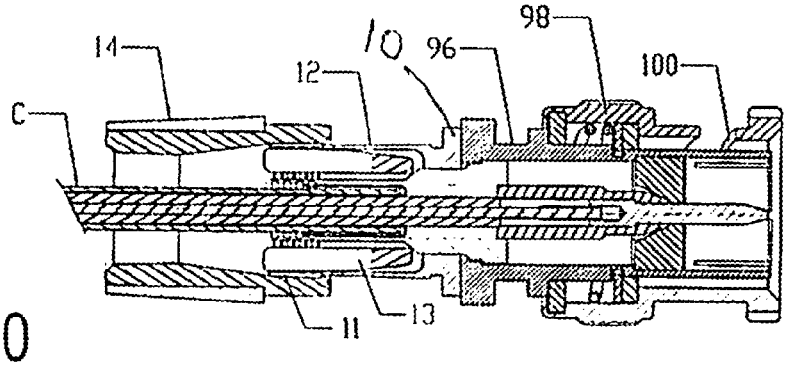
FIG. 10 is another longitudinal sectional view of the embodiment shown in FIG. 9 after advancement of the cable and extension tip through the connector assembly but prior to the crimping operation.
Figure 11:
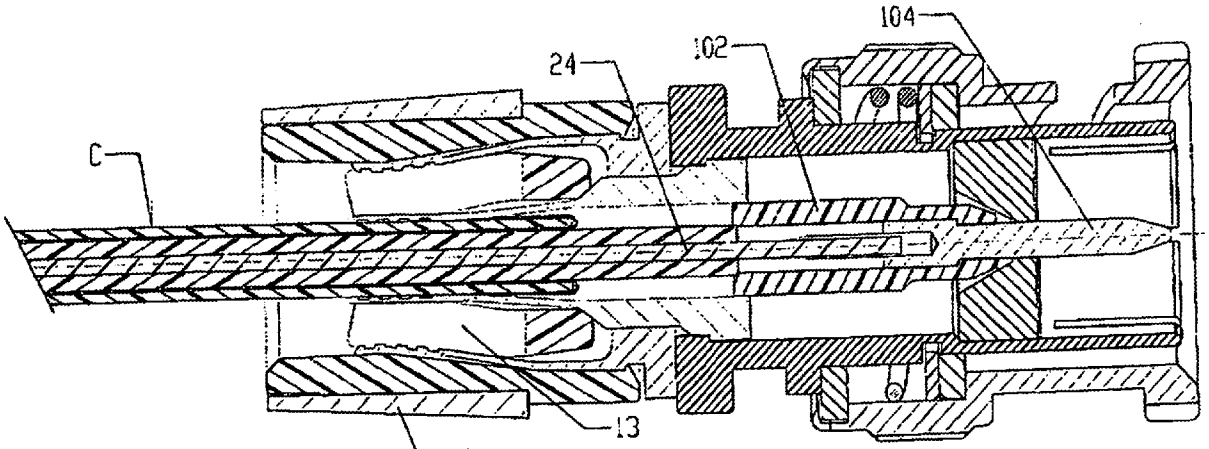
FIG. 11 is an enlarged longitudinal sectional view of the second embodiment shown in FIGS. 9 and 10 following the crimping operation.
Figure 13:
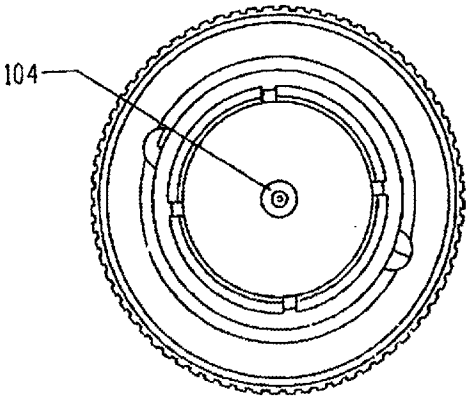
FIG. 13 is an end view taken from the opposite end of FIG. 11 to that of FIG. 12
Figure 12:
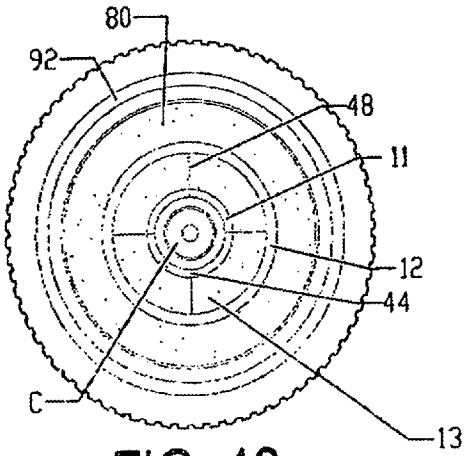
FIG. 12 is an end view taken from the entrance end of the cable in FIG. 11.

FIGS. 9 to 13 illustrate a modified form of connector assembly 10' for a BNC connector or fitting of increased length compared to the RCA connector shown in FIGS. 1 to 8 and having an elongated barrel 96 with a bayonet slot 98 connected to a ferrule 100 Inner and outer spaced connector sleeves 11 and 12 and compression ring 13 along with the crimping ring assembly correspond to those of FIGS. 1 to 8 and are correspondingly enumerated along with the cable C. Owing to the increased length of the fitting, the extension tip 16 is replaced by an insert socket 102 having a hollow nose 103 of reduced diameter which is slidably disposed within the inner sleeve 11, and an extension pin 104 is disposed on the exposed end of the conductor pin 22 of the cable C. Initially, as shown in FIG. 9, the pin 104 will guide the cable C into engagement with the socket 102. Continued advancement of the cable C will cause the pin 104 to carry the socket 102 into alignment with a beveled opening 106 in a stationary block 108 at the end of the ferrule 100 and until the pin 104 reaches the end of the ferrule 100, as shown in FIG. 10. In a manner corresponding to FIGS. 1 to 8, forward advancement of the crimping ring assembly 14 will crimp the inner sleeve 11 into positive engagement with the cable jacket 26, as illustrated in FIGS. 11 to 13; and as best illustrated in the end view of FIG. 12, the compression ring 13 can be dyed a specific color representing the size of cable C which will best fit and provide optimum crimping engagement with the connector body 10.

Detailed Description of First and Second Embodiments with Compression Tool

Figure 17:
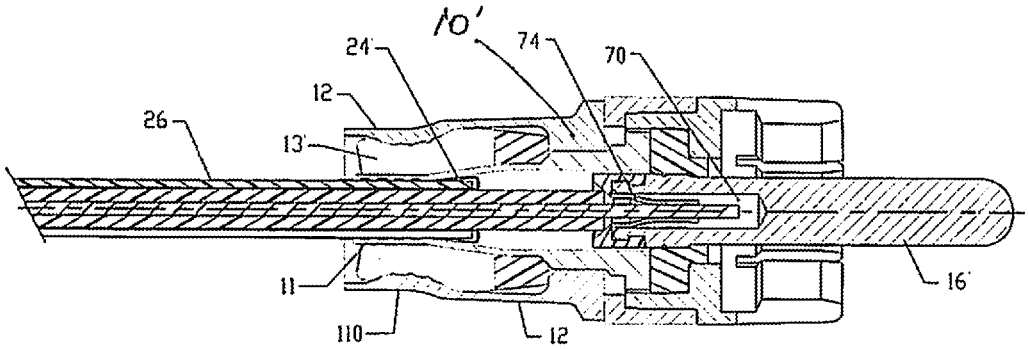
FIG. 17 is a longitudinal sectional view of the embodiment shown in FIGS. 14 and 15 after the crimping operation.

FIG. 14 illustrates a compression tool Tin place of a crimping ring assembly 14 previously described for crimping an RCA connector similar to that of FIGS. 1 to 8 and in which like parts of the cable C and connector body 10 are correspondingly enumerated. The principal modification is the utilization of an outer sleeve 12' having a convex raised surface portion 110. The cable C is inserted into the tip extender 16 so as to be anchored in chuck 112 and centered in relation to the dies 114, 115 as the dies 114, 115 are advanced into crimping engagement with the outer sleeve 12'. Again, and as shown in FIGS. 15 and 16, the connector body 10' includes an annular plastic insert 13' in the space between the inner and outer concentric sleeves 11' and 12' for the mini-coaxial cable represented at C, and the outer jacket 26 and braided insulator 24 are positively engaged by the inner sleeve 11' when the outer sleeve 12' and ring 13' are compressed radially inwardly by the compression tool T, as shown in FIG. 17.

Figure 18:
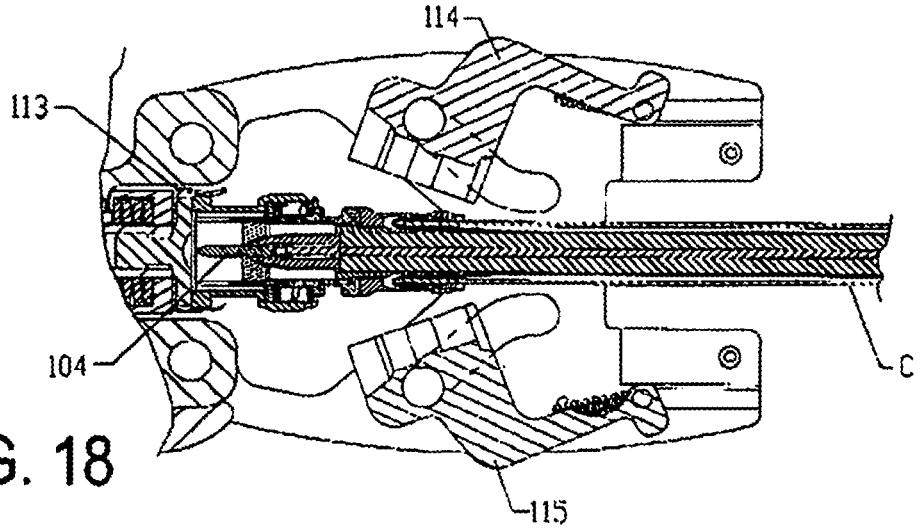
FIG. 18 is a longitudinal sectional view of still another embodiment with the parts assembled prior to advancement through the connector assembly.
Figure 19:
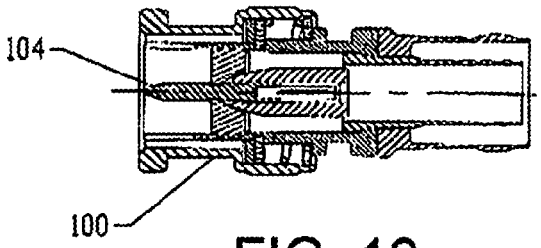
FIG. 19 is another sectional view corresponding to that of FIG. 18 with the coaxial cable and extension tip fully inserted into the connector assembly.
Figure 20:
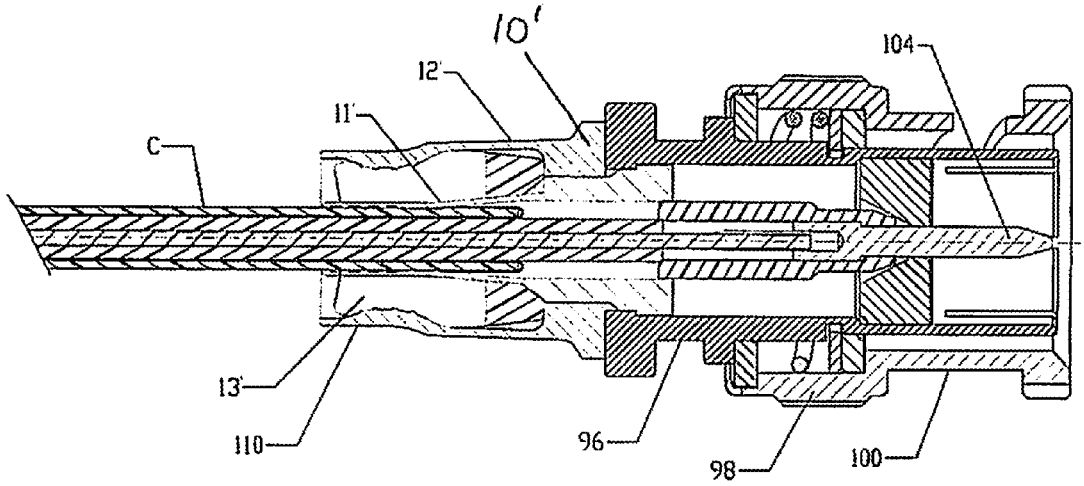
FIG. 20 is a longitudinal sectional view of the embodiment shown in FIGS. 18 and 19 following the crimping operation.

FIGS. 18 to 20 illustrate the manner in which the BNC connector of FIGS. 9 to 13 can be crimped by the compression tool T and specifically wherein the ferrule 100 is inserted between the spring clips 113 prior to compression of the sleeves 11 ', 12' and the compression ring 13' by the compression die members 114 and 115.

Mini-coaxial cables are particularly useful in cellular telephones, security cameras and other applications where there are decided space limitations or where short runs of cable are used. Referring to the embodiments shown and described, it will be evident that the thickness of the compression ring 13, as well as the width of the slots 44 and 48 may be varied according to the size or diameter of the cable C and be proportioned according to the space allowance between the cable C and the connector sleeve 11. Further, the compression ring may be installed either before or after shipment to the field. For example, it may be desirable for the installer to select a particular size of compression ring which would be dyed or colored to match a particular cable size. To that end, the compression ring 13 should have sufficient elasticity or spreadability to be inserted axially into the annular space between the assembled sleeves 11 and 12.

The resilient band 42 shown in FIG. 2, may be inserted into the groove formed between the ferrule 50 and the shoulder 40 after the connector has been crimped together into the closed position. The band 42 is manually stretchable over the end of the ferrule 50 and, when released, will contract into the groove as described. The band 42 also may be one of several different colors to signify the intended application of the connector to a particular use. In addition, the compression ring 13 as well as the guides 33 and 72 may be of different selected colors which represent the size of cable C for which the connector body 14 is designed. The cap is visible to the installer when inserting the cable C into the tip 16 prior to the crimping operation, and both the guide 33 and ring 13 are visible from either end of the connector body 10, as shown in FIGS. 5, 6 and 12, 13 after the crimping operation.

Detailed Description of Additional Embodiment

Figure 21:
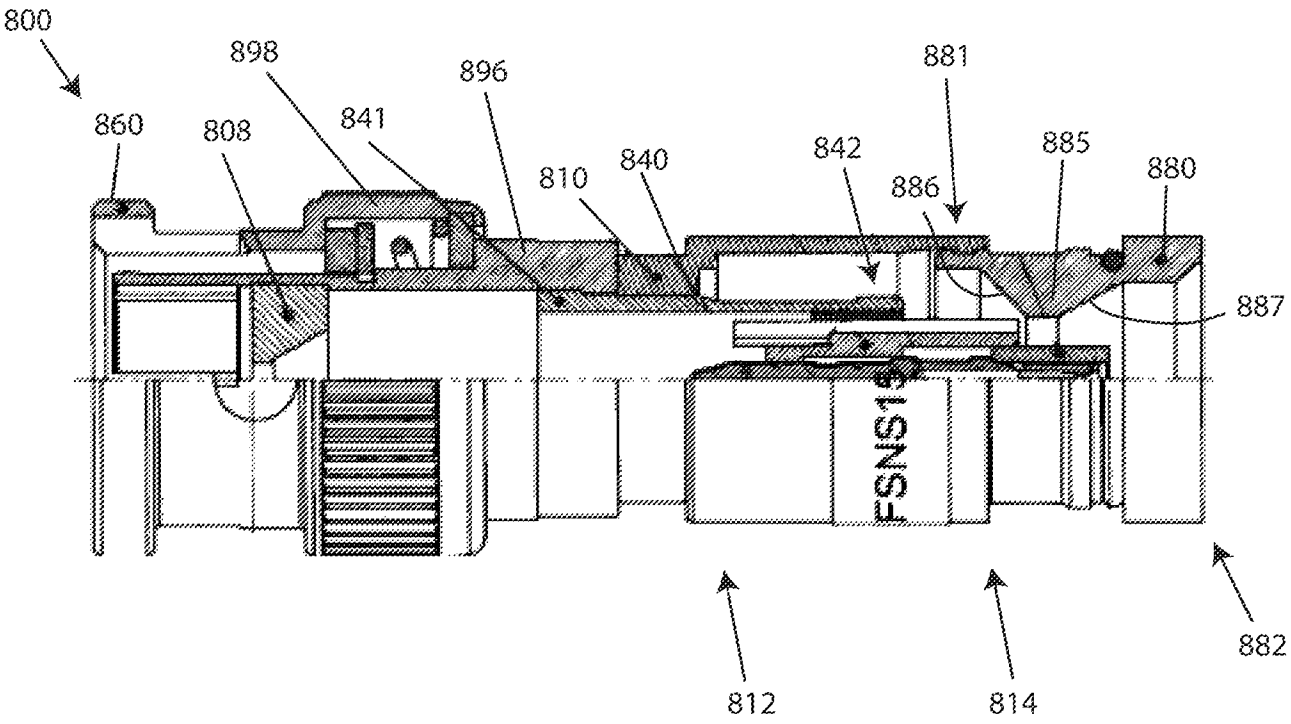
FIG. 21 depicts a partial cut-away view of an additional embodiment of a coaxial cable connector.

FIG. 21 depicts an embodiment of connector 800, which illustrates an additional embodiment of connector assembly 10' for a BNC connector or fitting of increased length compared to the RCA connector shown in FIGS. 1 to 8. Embodiments of connector 800 may share the same structural components and functional aspects as the connector as shown in FIGS. 9-13 and described supra. For instance, embodiments of connector 800 may include an elongated barrel 896 with a bayonet slot 898 connected to a ferrule 860, an inner sleeve 840, and a connector body 810.

Embodiments of the inner sleeve 840 may include the same structural and/or functional aspects as inner sleeve 11 described above. Embodiments of the inner sleeve 840 may include a first end 841 and a second end 842. The second end 842 of the inner sleeve 840 may receive the cable C. When the cable C is inserted, the center conductor may engage a moveable pin assembly configured to be driven through the connector 800 during installation and attachment of the connector 800 to the cable C. The prepared cable C is inserted into the tip 16' and advanced through the body 10 until the slotted segments of the inner sleeve are positioned over the doubled-over layer 24' and jacket 26. Moreover, the second end 842 may be slotted so as to facilitate compression of the second end of the inner sleeve 840. In other words, the second of the inner sleeve 840 may be provided with circumferentially spaced longitudinal slots, the slots each being of a width to control the inward degree of bending by a compression portion 885 of the compression sleeve 880.

Embodiments of the connector body 810 may have a first end 812 and a second end 814. The second end 814 of the connector body 810 may include a retention feature, such as a lip, annular detent, edge, and the like, for structurally retaining a compression sleeve 880 in a preassembled position. In the preassembled position, the connector sleeve 880 is not axially advanced to a compressed position. In other embodiments, the connector body 810 may include more than one retention feature proximate, at, or otherwise near the second end 814. The retention feature of the connector body 810 may structurally correspond to a structural feature on the compression sleeve 880. The structural cooperation between the retention feature of the connector body 810 and the structural feature on the compression sleeve 880 may act to retain the two components together in a preassembled position. Embodiments of the structural feature of the compression sleeve 880 may be located at, proximate, or otherwise near the first end 881 of the compression sleeve 880. There may be more than one structural engagement feature of the compression sleeve to cooperate with the retention feature of the connector body 810.

Furthermore, embodiments of the compression sleeve 880 may include a first end 881, a second end 882, a compression portion 885 having a forward facing surface 886 and a rearward facing surface 887. Embodiments of the compression sleeve 880 may be operably connected to the connector body 810 in a preassembled position, or may be attached in the field. Embodiments of the compression sleeve 880 may be a compression member, a fastener member, and the like, configured to functionally engage a connector body 810 and create a seal against the cable C when axially compressed toward the front end of the connector 800. Embodiments of the compression portion 885 may be structurally integral with the compression sleeve 880; however, a separate component sharing its structural design may be attached to an inner surface of the compression sleeve 880. Embodiments of the compression portion 885 may protrude from an inner surface of the compression sleeve 880 a significant distance to ensure engagement with the second end 842 of the inner sleeve 840. The forward facing surface 886 and the rearward facing surface 887 may be tapered or ramped to allow or assist the compression sleeve 880 to move axially forward within the connector body 810, while exerting a gradually increasing compressive force against the slotted end 842 of the inner sleeve 840 until a fully compressed position is achieved. The radially inward compression of the second end 842 of the inner sleeve 840 may result in radial compression of the prepared end of the cable C. For instance, the second end 842 of the inner sleeve 840 may be compressed into sealing or sufficient mechanical interference with the doubled-over braided layer (i.e. outer conductor) of the cable C. Thus, a fastener member, such as compression member 880 may directly apply a compressive force against the inner sleeve 840 to grip, secure, and/or seal the outer conductor of the cable C when the cable C is installed within the connector 800. The direct compressive force against the second end 842 of the inner sleeve 840 onto the cable C requires less compression than having to compressive an outer connector body, a sleeve insert, and an inner sleeve onto the cable.

It is therefore to be understood that while different embodiments are herein set forth and described, the above and other modifications may be made therein without departing from the spirit and scope of the invention as defined by the appended claims and reasonable equivalents thereof.

The following is claimed:

1. A cable connector comprising:

a connector body defining a main bore along an elongate axis, a first end, and a second end extending axially aft of the first end:

an inner sleeve disposed within the main bore of the connector body and including a plurality of flexible compression segments separated by a plurality of axial slots;

an extension tip having a first end and a second end disposed within the main bore, the extension tip configured to engage a conductor pin of a coaxial cable at the first end;

an extension rod removably connected to the second end of the extension tip;

wherein the extension rod and the extension tip are configured to slide within the main bore to accommodate different assembly configurations and cable sizes; and a compression member operably connected to a second end of the connector body, the compression member including a compression portion having a forward facing surface, wherein the compression portion protrudes from an inner surface of the compression member, the compression member being configured to compress a portion of the compression segments of the inner sleeve into crimping engagement with the coaxial cable.

2. The cable connector of claim 1, wherein the extension rod includes a projection at one end.

3. The cable connector of claim 2, wherein the extension tip includes a recess at an opposite end that is configured for press-fit engagement with the projection.

4. The cable connector of claim 1, further comprising a fastener member extending from a first end of the connector body for interchangeable connection to one of a plurality of electronic devices.

5. The cable connector of claim 1, wherein the portion of the inner sleeve is compressed onto a doubled-over, braided layer of the coaxial cable.

6. The cable connector of claim 1, wherein the coaxial cable is a mini-coaxial cable.

7. A coaxial cable connector comprising:

a connector body defining a main bore, the main bore traversing the connector body from a first end to a second end;

a compression member operably connected to the second end of the connector body;

an inner sleeve including a plurality of elongate slots defining a plurality of axially extending compression segments, each compression segment having a leading end and a trailing end, a portion of the trailing end being configured to contact compression member being configured to contact a compression segment such that the trailing end thereof is and be compressed into engagement with a coaxial cable; and an extension tip having a first end and second end inserted in the main bore, the extension tip configured to engage a conductor pin of the coaxial cable at the first end and removeably connect to an extension rod at the second end, and wherein the extension tip and the extension rod are slidable within and through the main bore in response to axial movement of the coaxial cable and conductor pin through the main bore.

8. The coaxial cable connector of claim 7, wherein the extension rod includes a projection at one end.

9. The coaxial cable connector of claim 8, wherein the extension tip includes a recess at the opposite end that is configured for press-fit engagement with the projection of the extension rod.

10. The coaxial cable connector of claim 7, further comprising a fastener member extending from the first end of the connector body for interchangeable connection to one of a plurality of electronic devices.

11. The coaxial cable connector of claim 7, wherein at least part of the inner sleeve is disposed within the main bore of the connector body.

12. The coaxial cable connector of claim 7, wherein the coaxial cable is a mini-coaxial cable.

13. A connector comprising:

a connector body defining a main bore;

an inner sleeve disposed in the main bore and mounted to the connector, the inner sleeve having a plurality of circumferentially-spaced slots defining a plurality of axially extending compression segments;

an extension structure disposed within the main bore, the extension structure having a first end configured to engage a conductor pin of a coaxial cable and a second end configured to engage an extension rod, and wherein the extension structure and the extension rod is configured to slide within the main bore to accommodate different coaxial cable configurations and sizes; and a compression sleeve disposed within at least a portion of the main bore, the compression sleeve configured to compress a portion of the slotted end of the inner sleeve into crimping engagement with the coaxial cable.

14. The connector of claim 13, wherein the compression sleeve further comprises a compression portion, the compression portion protruding from an inner surface of the compression sleeve.

15. The connector of claim 14, wherein the compression portion is structurally integral to the compression sleeve.

16. The connector of claim 14, wherein the compression portion includes a ramped surface configured to gradually compress the slotted end of the inner sleeve into crimping engagement with the portion of the coaxial cable.

17. The connector of claim 13, wherein a portion of the inner sleeve is disposed within the main bore.

18. The connector of claim 13, wherein axially advancing the conductor pin through the main bore into engagement with the extension structure causes the extension structure to slide in an axial direction within the main bore.

19. A cable connector comprising:

a connector body defining a main bore;

an extension rod disposed and centered within the main bore;

an extension tip having a first end and a second end disposed and centered within the main bore, the extension tip configured to receive a conductor pin of a coaxial cable at the first end and guide the conductor pin into the main bore, the extension tip configured to guide the extension rod out the second end of the connector body;

the extension rod and extension tip, in combination, being configured to slide within the main bore to guide and receive different coaxial cable configurations and sizes;

a sleeve disposed in the main bore and mounted to the connector, the sleeve having a plurality of circumferentially-spaced slots defining a plurality of axially extending compression segments, the compression segments each configured for form an effective hinge portion extending tangential to a circumference of the sleeve and a compression end;

a compression member slidably mounted to the second end of the connector body, the compression member including a compression portion protruding inwardly and contacting a portion of the compression segments between the effective hinge portion and the compression end to flex the compression end into frictional engagement with an outer jacket of a coaxial cable so as to fit different coaxial cable configurations and sizes.

20. The connector of claim 19, wherein axially advancing the conductor pin through the main bore into engagement with the extension tip causes the extension tip to slide in an axial direction within the main bore.

21. The connector of claim 19, wherein a width of the slots is configured to controls flexure of the compression segments in response to contact by the compression member.

22. The connector of claim 19 wherein the compression end of each compression segment includes a plurality of serrations to effect frictional and mechanical engagement with the outer jacket of the coaxial cable.

23. The connector of claim 19, wherein the extension tip includes a recess at the opposite end that is configured for press-fit engagement with the projection of the extension rod.

24. The connector of claim 19, wherein the compression member includes a ramped surface configured to gradually compress the sleeve into crimping engagement around different coaxial cable configurations and sizes.

25. The connector of claim 24, wherein the compression member includes a ramped surface configured to gradually crimp the sleeve around the cable when the compression member axially moves from the uncrimped position to the crimped position.

26. A cable connector for being compressively fit around a plurality of different sizes and shapes of a cable comprising:

a connector body defining a main bore;

an extension tip having a first end and a second end disposed within the main bore, the extension tip configured to engage a conductor pin of the cable at the first end;

an extension rod removably connected to the second end of the extension tip;

wherein the extension rod and the extension tip are configured to slide within the main bore;

an inner compression sleeve member configured to be compressively fit around a plurality of different sizes and shapes of the cable;

an outer compression ring member configured to axially move relative to the inner compression sleeve member so as compressively fit the inner compression sleeve member around the plurality of different sizes and shapes of the cable; and wherein the inner compression sleeve member has a plurality of longitudinally extending inner compression segments that are circumferentially separated by a plurality of longitudinally extending inner slots so as to control inner degrees of bending of the plurality of longitudinally extending inner compression segments when the outer compression ring member axially moves relative to the inner compression sleeve member and compressively fit the plurality of longitudinally extending inner compression segments around the plurality of different sizes and shapes of the cable.

27. The connector of claim 26, wherein the extension tip and the extension rod are configured to accommodate the plurality of different sizes and shapes of the cable.

28. The connector of claim 26, wherein the inner compression sleeve member has an inner trailing end, and the plurality of longitudinally extending inner compression segments extend from the inner trailing end of the inner compression sleeve member toward a rearward direction away from an interface port when the connector is installed on the interface port.

29. The connector of claim 26, wherein the outer compression ring member includes a plurality of longitudinally extending outer compression segments that are circumferentially separated by a plurality of longitudinally extending outer slots so as to control outer degrees of bending of the plurality of longitudinally extending outer compression segments when the outer compression ring member axially moves relative to the inner compression sleeve member and compressively fit the plurality of longitudinally extending inner compression segments around the plurality of different sizes and shapes of cable.

30. The connector of claim 29, wherein the outer compression ring member has an outer trailing end, and the plurality of longitudinally extending outer compression segments extend from the outer trailing end of the outer compression ring member toward a rearward direction away from an interface port when the connector is installed on the interface port.

31. The connector of claim 26, wherein the outer compression ring member includes a ramped surface configured to gradually compress the inner compression sleeve member into crimping engagement around different coaxial cable configurations and sizes.

32. The connector of claim 26, wherein the outer compression ring member is configured to axially move from an uncrimped position, where the inner compression sleeve member is not crimped around a cable, and a crimped position, where the inner compression sleeve member is crimped around the cable.

33. The connector of claim 32, wherein the outer compression ring member includes a ramped surface configured to gradually crimp the inner compression sleeve member around the cable when the outer compression ring member axially moves from the uncrimped position to the crimped position.

34. A cable connector for being compressively fit around a plurality of different sizes and shapes of a cable comprising:

a connector body defining a main bore;

an extension tip having a first end and a second end disposed within the main bore, the extension tip configured to engage a conductor pin of the cable at the first end;

an extension rod removably connected to the second end of the extension tip;

wherein the extension rod and the extension tip are configured to slide within the main bore:

an inner compression sleeve member configured to be compressively fit around a plurality of different sizes and shapes of the cable;

an outer compression ring member configured to axially move relative to the inner compression sleeve member so as compressively fit the inner compression sleeve member around the plurality of different sizes and shapes of the cable;

wherein the inner compression sleeve member has a plurality of longitudinally extending inner compression segments that are circumferentially separated by a plurality of longitudinally extending inner slots so as to control inner degrees of bending of the plurality of longitudinally extending inner compression segments when the outer compression ring member axially moves relative to the inner compression sleeve member and compressively fit the plurality of longitudinally extending inner compression segments around the plurality of different sizes and shapes of the cable;

wherein the inner compression sleeve member has an inner trailing end, and the plurality of longitudinally extending inner compression segments extend from the inner trailing end of the inner compression sleeve member toward a rearward direction away from an interface port when the connector is installed on the interface port;

wherein the outer compression ring member includes a plurality of longitudinally extending outer compression segments that are circumferentially separated by a plurality of longitudinally extending outer slots so as to control outer degrees of bending of the plurality of longitudinally extending outer compression segments when the outer compression ring member axially moves relative to the inner compression sleeve member and compressively fit the plurality of longitudinally extending inner compression segments around the plurality of different sizes and shapes of the cable; and wherein the outer compression ring member has an outer trailing end, and the plurality of longitudinally extending outer compression segments extend from the outer trailing end of the outer compression ring member toward the rearward direction away from an interface port when the connector is installed on the interface port.

35. The connector of claim 34, wherein the extension tip and the extension rod are configured to accommodate the plurality of different sizes and shapes of the cable.

36. The connector of claim 34, wherein the outer compression ring member includes a ramped surface configured to gradually compress the inner compression sleeve member into crimping engagement around different cable configurations and sizes.

37. The connector of claim 34, wherein the outer compression ring member is configured to axially move from an uncrimped position, where the inner compression sleeve member is not crimped around a cable, and a crimped position, where the inner compression sleeve member is crimped around the cable.

38. The connector of claim 37, wherein the outer compression ring member includes a ramped surface configured to gradually crimp the inner compression sleeve member around the cable when the outer compression ring member axially moves from the uncrimped position to the crimped position.

* * * * *